US006349712B1

(12) United States Patent
Halstead

(10) Patent No.: US 6,349,712 B1
(45) Date of Patent: Feb. 26, 2002

(54) SAW EXTENSION

(76) Inventor: David Halstead, 5273 Alpine Meadows Ct., Alta Loma, CA (US) 91737

( * ) Notice: Subject to any disclaimer, the term of this patent is extended or adjusted under 35 U.S.C. 154(b) by 0 days.

(21) Appl. No.: 09/768,654

(22) Filed: Jan. 19, 2001

(51) Int. Cl.[7] ..... B28D 1/04

(52) U.S. Cl. ..... 125/12; 125/13.01; 125/13.03; 30/370; 30/371; 30/379

(58) Field of Search ..... 125/1, 13.01, 13.03; 451/352; 30/370, 371, 373, 379, 390, 389, 388; 83/674

(56) References Cited

U.S. PATENT DOCUMENTS

| | | | | | |
|---|---|---|---|---|---|
| 2,736,311 | A | * | 2/1956 | Coates | 125/12 |
| 3,722,496 | A | | 3/1973 | Schuman | |
| 4,188,935 | A | | 2/1980 | Tubesing | |
| 4,456,303 | A | * | 6/1984 | Due | 299/10 |
| 4,928,662 | A | | 5/1990 | Chiuminatta et al. | |
| 4,938,201 | A | | 7/1990 | Chiuminatta et al. | |
| 5,184,597 | A | | 2/1993 | Chiuminatta et al. | |
| 5,381,780 | A | * | 1/1995 | Yelton et al. | 125/14 |
| 5,540,210 | A | | 7/1996 | Jones | |
| 5,661,960 | A | * | 9/1997 | Smith et al. | 56/12.7 |
| 5,941,227 | A | | 8/1999 | Bearden | |
| 6,019,433 | A | * | 2/2000 | Allen | 125/13.01 |
| 6,112,736 | A | | 9/2000 | Bearden | |

OTHER PUBLICATIONS

Concrete Construction, photograph on p. 58 Oct. 2000.

* cited by examiner

*Primary Examiner*—Eileen P. Morgan
(74) *Attorney, Agent, or Firm*—Eric Karich

(57) ABSTRACT

A saw extension for supporting a hand-held portable rotary saw has a base, a plurality of wheels positioned to support the base above a surface, and an upwardly extending arm extending from the base to a control grip. The hand-held portable rotary saw is removably attached to the base with at least one locking pin positioned through a guide plate of the hand-held portable rotary saw and into at least one locking aperture of the base. The saw extension includes a power control mechanism mounted adjacent the control grip. The power control mechanism includes a power socket into which a saw power cord of the hand-held portable rotary saw can be plugged, a master power cord for electronically connecting the power socket with an external power source, and a trigger switch for operably controlling the flow of power to the hand-held portable rotary saw.

6 Claims, 4 Drawing Sheets

SAW EXTENSION

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to saw extensions, and more particularly to a saw extension for use with an ordinary hand operated power saw.

2. Description of Related Art

The following art defines the present state of this field: Chiuminatta et al., U.S. Pat. Nos. 4,938,201, 4,928,662, and 5,184,597, teach a rotating cutting blade and drive motor mounted upon a wheeled support platform. The Chiuminatta device includes a skid plate that contacts a soft concrete surface. The slot and the skid plate are preferably shaped and sized to support the soft concrete being cut to be cut to prevent cracking and chipping of the unhardened concrete.

Bearden, U.S. Pat. No. 5,941,227 and 6,112,736, teach an extension platform for mounting a hand saw for use in cutting concrete with an ordinary hand saw. The extension platform includes a planar base, flared sidewalls extending from the planar base, and a slot for receiving the saw blade of the hand saw. The extension platform includes an arm for pushing the extension platform and two pairs of rollers for directing the rectilinear travel.

While Bearden teaches an extension platform for mounting a hand saw, and also teaches the use of a clasp to hold the power switch of the hand saw in the "ON" position, it does not teach a power control mechanism that allows the user to regulate power to the hand saw while in use. The present invention fulfills these needs and provides further related advantages as described in the following summary.

SUMMARY OF THE INVENTION

The present invention teaches certain benefits in construction and use which give rise to the objectives described below.

The present invention provides a saw extension for supporting a hand-held portable rotary saw above a surface and for cutting the surface with the hand-held portable rotary saw. The saw extension includes a base, a means for removably fastening the hand-held portable rotary saw to the base, a plurality of wheels positioned to support the base above the surface for rectilinear movement thereupon, and an upwardly extending arm extending from the base to a control grip, the upwardly extending arm being positioned for pushing the base across the surface. Finally, the saw extension includes a power control mechanism mounted adjacent the control grip for operably controlling the hand-held portable rotary saw.

A primary objective of the present invention is to provide a saw extension having advantages not taught by the prior art.

Another objective is a saw extension that enables control of the hand-held portable rotary saw through a trigger switch positioned in an upwardly extending arm of the saw extension.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
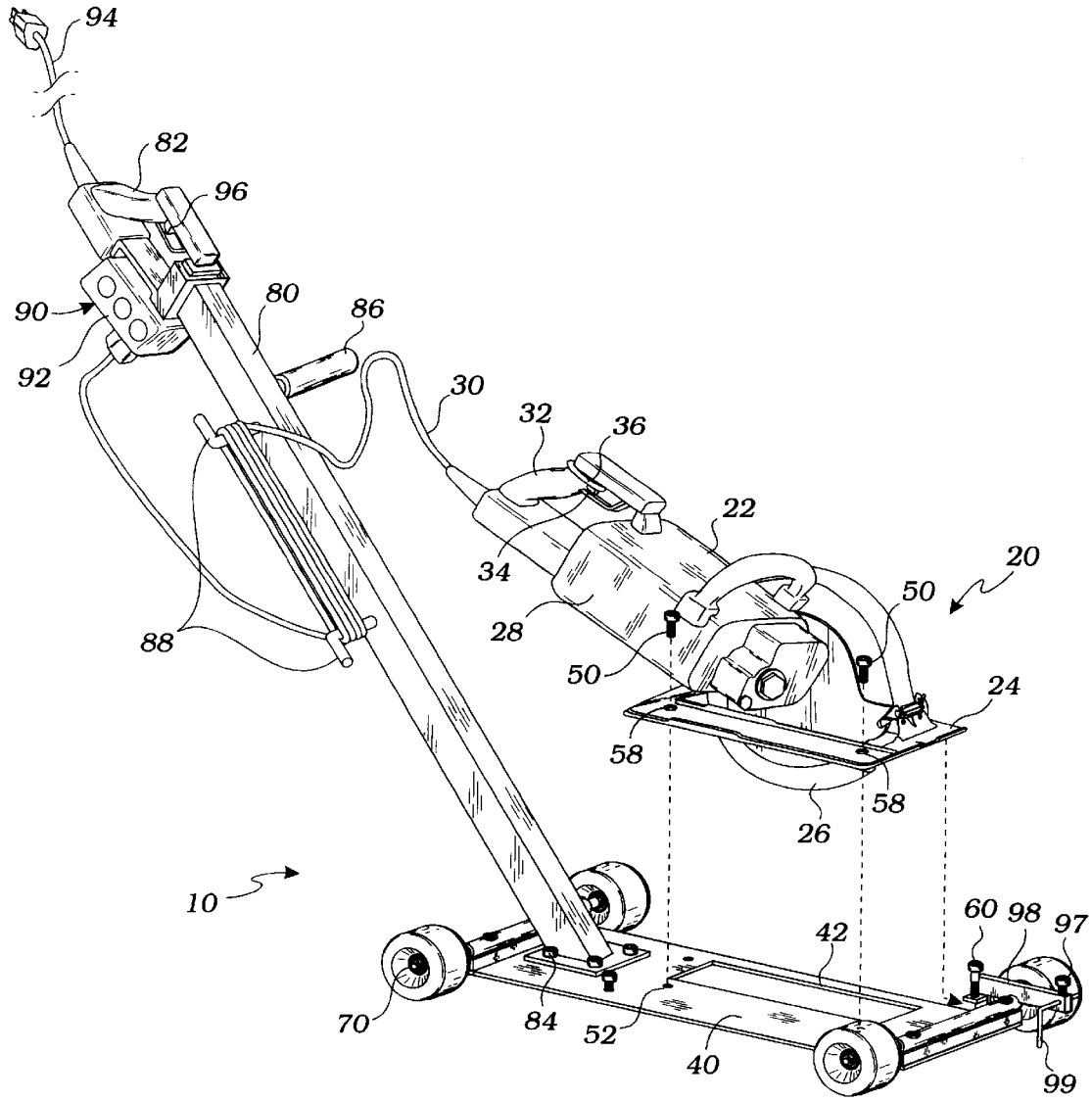
FIG. 1 is a perspective view of the preferred embodiment of the present invention.

The above-described drawing figures illustrate the invention, a saw extension 10 for supporting a hand-held portable rotary saw 20 above a surface 12 and for cutting the surface 12 with the hand-held portable rotary saw 20. The saw extension 10 includes a base 40, a means for removably fastening the hand-held portable rotary saw 20 to the base 40, a plurality of wheels 70 positioned to support the base 40 above the surface 12 for rectilinear movement thereupon, and an upwardly extending arm 80 extending from the base 40 to a control grip 82, the upwardly extending arm 80 being positioned for pushing the base 40 across the surface 12. Finally, the saw extension 10 includes a power control mechanism 90 mounted adjacent the control grip 82 for operably controlling the hand-held portable rotary saw 20.

Figure 3:
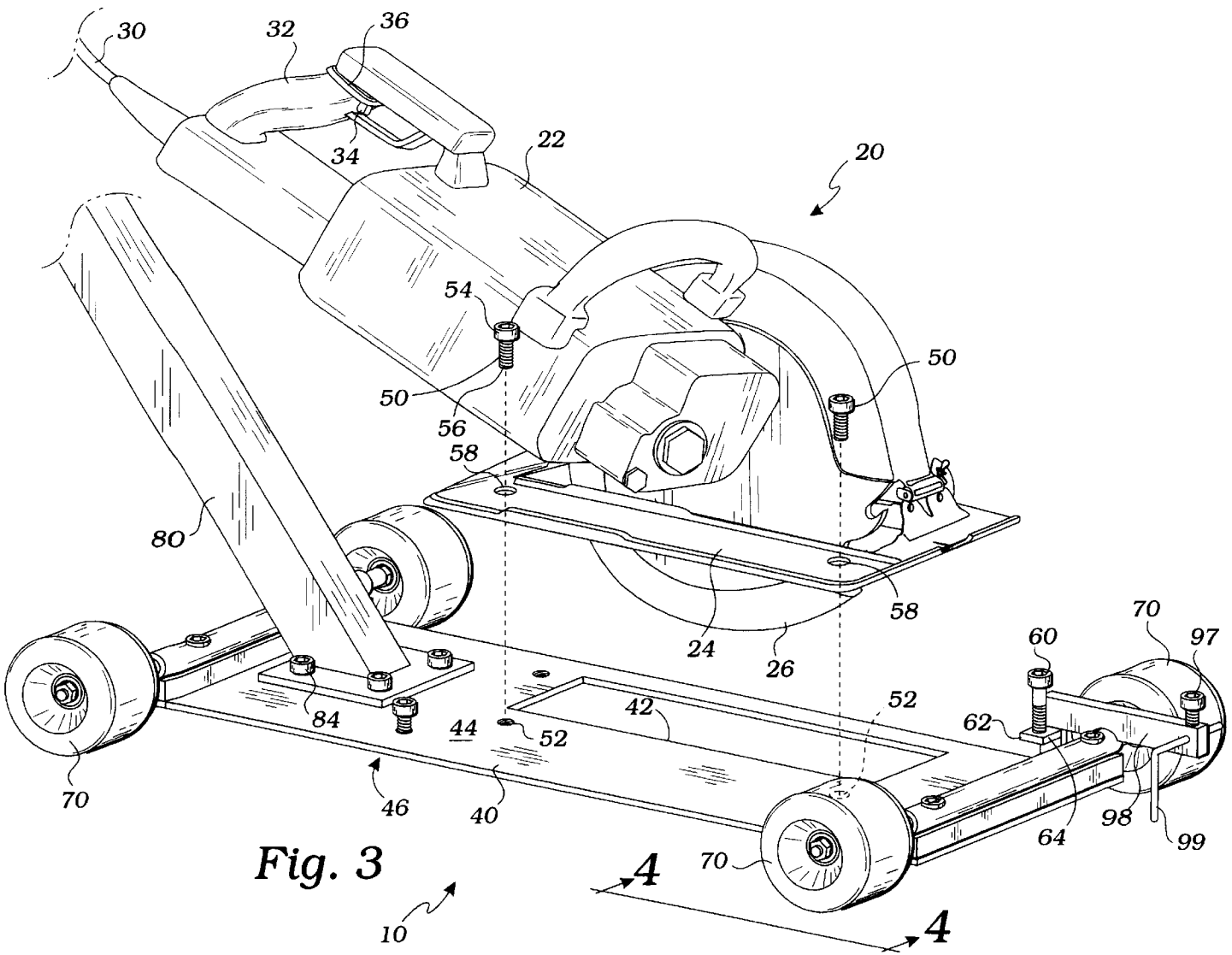
FIG. 3 is a perspective view of a base.

As shown in FIGS. 1 and 3, the hand-held portable rotary saw 20 has a housing 22, a guide plate 24, a saw blade 26 attached to the housing 22 and rotatable relative thereto about an axis of rotation, and a motor 28 operably connected to the saw blade 26. The motor 28 is electrically connected to a saw power cord 30, and operably controlled with a saw switch 34. The housing 22 includes a saw grip 32 constructed of molded plastic and shaped to fit the user's hand. The saw switch 34 is integrated into the saw grip 32 for easier control of the hand-held portable rotary saw 20. The saw switch 34 pivots between an unpowered position and a powered position. The saw switch 34 is biased towards the unpowered position, yet can readily be depressed to the powered position. When the hand-held portable rotary saw 20 is mounted upon the saw extension 10, the saw switch 34 is clamped in the powered position with a fastening strap 36 such as a plastic tie strip, a strap having hooks and loops such as VELCRO®, a strip of tape, or another equivalent mechanism known to those skilled in the art. The details of the hand-held portable rotary saw 20 and the fastening strap 36 are described in Bearden, U.S. Pat. No. 6,112,736, hereby incorporated by reference. The hand-held portable rotary saw 20 is preferably a Model 77 saw manufactured by Skil Corporation, of Chicago, Ill., although the saw extension 10 can be adapted to use a variety of hand-held saws.

As shown in FIGS. 1–5, the saw extension 10 is shaped for supporting the hand-held portable rotary saw 20 above the surface 12 and for cutting the surface 12 without requiring the user to crawl across the surface 12 pushing the hand-held portable rotary saw 20 with his or her hand. The base 40 of the saw extension 10 defines a slot 42 that is shaped to allow the saw blade 26 to be positioned therethrough once the hand-held portable rotary saw 20 is mounted upon the saw extension 10. The slot 42 is substantially larger than a standard saw blade to easily accommodate a wide variety of blades, and the slot 42 is preferably approximately 1.5 inches wide. The base 40 includes a planar upper surface 44 and, opposing, a planar lower surface 46. The planar upper surface 44 is preferably shaped to contact the guide plate 24 of the hand-held portable rotary saw 20. The planar lower surface 46 is preferably shaped to allow the saw extension 10 to move above and in close proximity to the surface 12 without interference. The base 40 is constructed of a rigid and durable material such as steel, although other materials can be adapted to the purposes described above by those skilled in the art.

As shown in FIGS. 1 and 3–5, the base 40 includes a means for removably fastening the hand-held portable rotary saw 20 to the base 40. The means for removably fastening preferably includes at least one locking pin 50 and at least one locking aperture 52 in the base 40. The at least one locking pin 50 is shaped to removably engage the at least one locking aperture 52, preferably through a threaded engagement, although those skilled in the art can devise other methods of attachment. The at least one locking pin 50 includes a head 54 and a body 56.

The head 54 is shaped to removably engage the guide plate 24 of the hand-held portable rotary saw 20 when the body 56 of the at least one locking pin 50 is inserted through a guide plate 24 aperture of the guide plate 24 and removably engaged with the at least one locking aperture 52 of the base 40. The head 54 is preferably shaped to receive a wrench 100 so that the at least one locking pin 50 can be readily locked in place or removed while in use. In the preferred embodiment, two locking pins are used, and they are inserted into two locking apertures in the base 40. The two locking apertures 52 are positioned to correspond with two guide plate 24 apertures that are already provided in a typical saw manufactured by the Skil Corporation.

The means for removably fastening preferably further includes a clamping screw 60 and a locking plate 62, the locking plate 62 being supported above the base 40 by a locking sidewall 64. The clamping screw 60 threadedly engages the locking plate 62 such that the clamping screw 60 moves towards or away from the base 40 when the clamping screw 60 is rotated. When the guide plate 24 is positioned on the planar upper surface 44 of the base 40, the clamping screw 60 can be used to clamp the guide plate 24 against the base 40 when the guide plate 24 is positioned against the locking sidewall 64.

Figure 4:
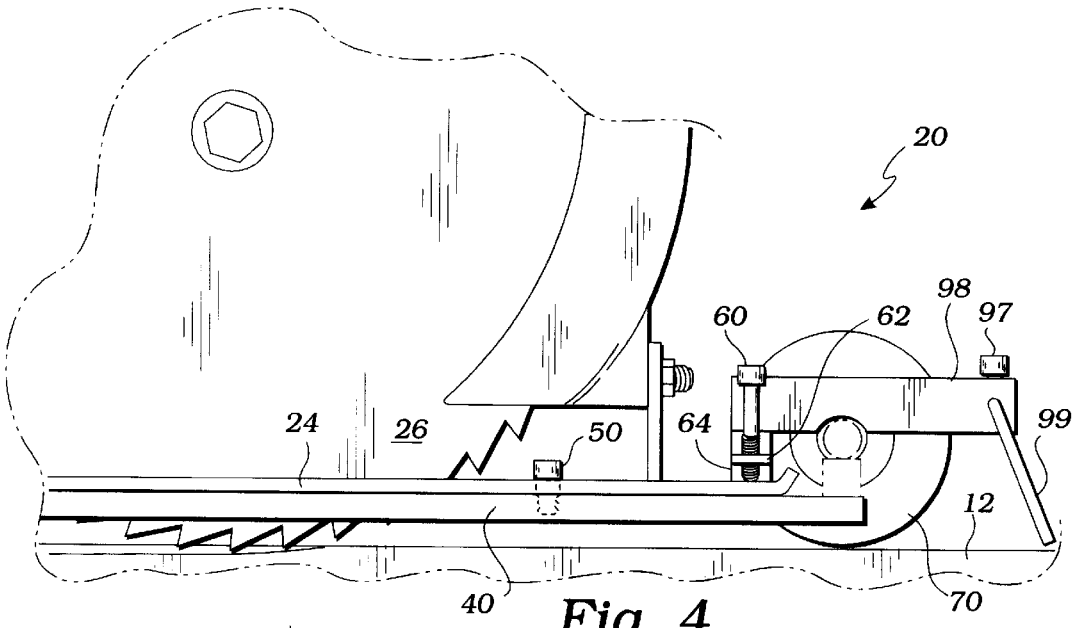
FIG. 4 is a side elevational view thereof taken along line 4—4 in FIG. 3.

The plurality of wheels 70 are positioned to support the base 40 above the surface 12 for rectilinear movement thereupon. In the preferred embodiment, as shown in FIGS. 1 and 3, the plurality of wheels 70 includes four wheels, one wheel being located at each comer of the base 40 for maximum stability. As shown in FIG. 4, the plurality of wheels 70 support the base 40 above the surface 12, but close enough to the surface 12 so that the saw blade 26 can be easily lowered to reach the surface 12 for cutting the surface 12. In the preferred embodiment, the planar lower surface 46 is supported approximately ¼ inch above the surface 12.

The upwardly extending arm 80 extends upwardly from the base 40 to a control grip 82. The upwardly extending arm 80 is positioned for pushing the base 40 across the surface 12. The upwardly extending arm 80 is preferably constructed of rigid and durably material such as steel, and is long enough to reach about the waist of the average user, preferably about 28 inches, thereby enabling the user to readily grasp the control grip 82 and push the saw extension 10. The upwardly extending arm 80 is preferably attached to the base 40 with bolts 84 so that the upwardly extending arm 80 can readily be removed from the base 40 for storing and transporting the saw extension 10; although, in alternative embodiments, the upwardly extending arm 80 is attached with equivalent attachment mechanisms, or is integrally attached through welding. The control grip 82 is preferably a molded plastic grip shaped to allow the user to easily and securely grip the control grip 82 to push and control the upwardly extending arm 80. The control grip 82 is most preferably shaped to be identical to the saw grip 32 so that the user get the feeling of operating the hand-held portable rotary saw 20 directly even though he or she is operating the hand-held portable rotary saw 20 through the intermediary of the saw extension 10.

Figure 2:
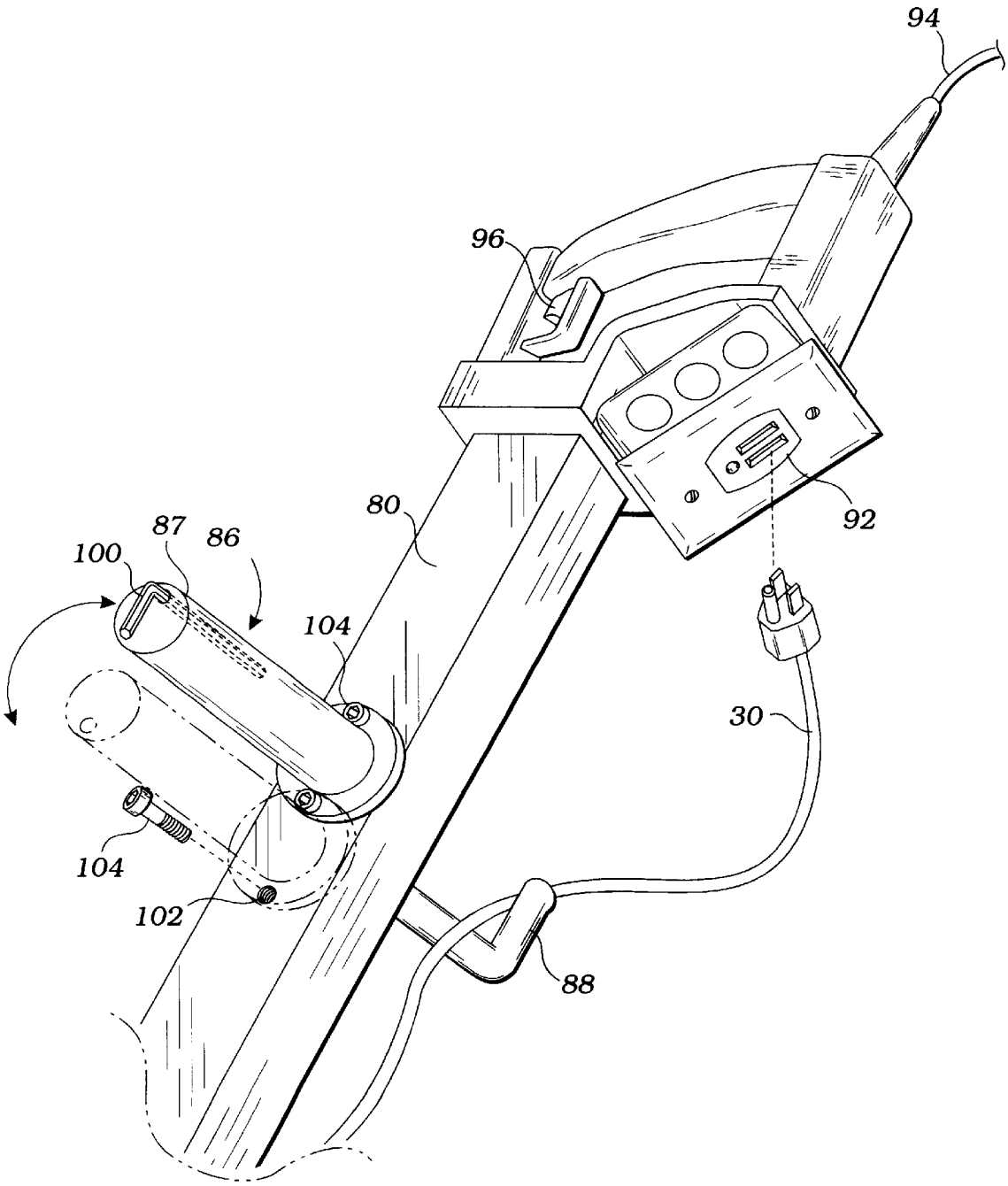
FIG. 2 is a perspective view of an upwardly extending arm, a control grip, and a power control mechanism.

As shown in FIG. 2, the upwardly extending arm 80 preferably further includes a second grip bar 86 extending laterally from the upwardly extending arm 80. The second grip bar 86 assists the user in controlling the movement of the saw extension 10. The second grip bar 86 is preferably attached to the upwardly extending arm 80 with at least one grip bolt 102 that removably engages at least one grip aperture 104. There are preferably at least two grip apertures 104 so that the second grip bar 86 can be adjustably mounted on the upwardly extending arm 80. The second grip bar 86 preferably includes a resilient grip cover 87 to enable the user to firmly grip the second grip bar 86. The second grip bar 86 preferably includes a means for storing the wrench 100 so that the wrench can be conveniently stored where it will be needed. The means for storing the wrench 100 is preferably a wrench aperture 106 in the resilient grip cover 87, the resilient nature of the resilient grip cover 87 functioning to grip the wrench 100 and prevent the wrench 100 from falling out of the wrench aperture 106.

Figure 5:
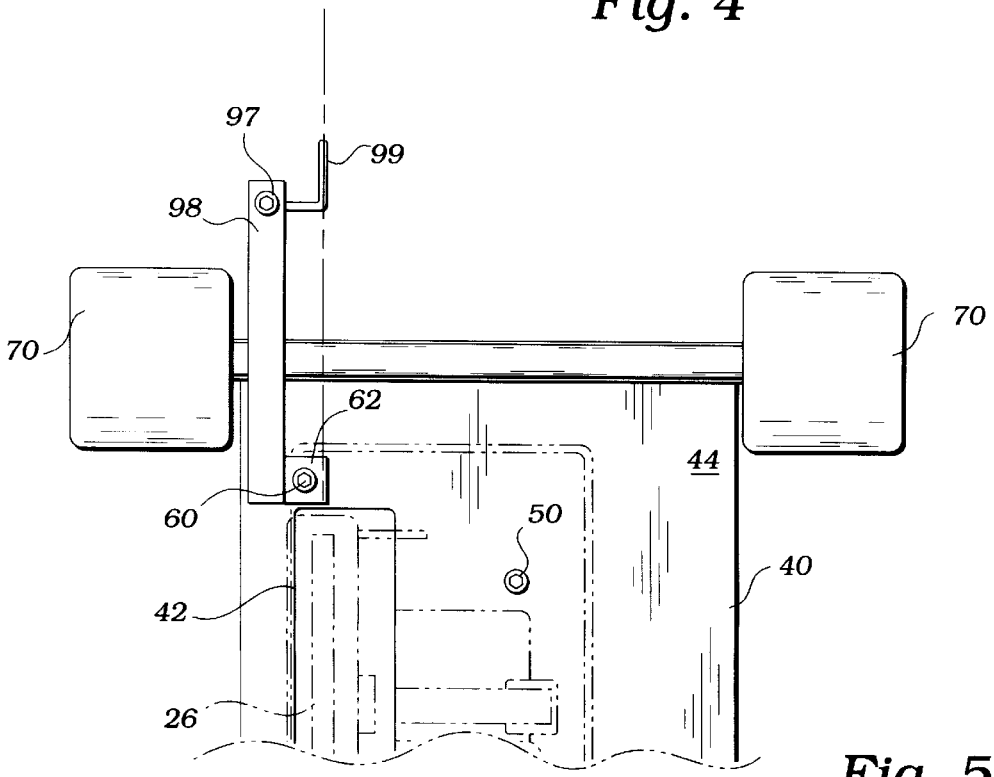
FIG. 5 is a top plan view thereof illustrating how a marking pin mounted on a guide arm is positioned in line with the axis of rotation of a saw blade to guide the use of the hand-held portable rotary saw when it is mounted upon the saw extension.

As shown in FIGS. 1 and 3–5, the saw extension 10 preferably further includes a guide arm 98 that extends forward of the base 40. As shown in FIG. 5, the guide arm 98 supports a marking pin 99 such that the marking pin 99 is positioned in line with the axis of rotation of the saw blade 26. The marking pin 99 is preferably pivotally attached to the guide arm 98 so that it can be pivoted to the position preferred by the user and locked into place with a marking pin lock 97. The user directs the saw extension 10 as guided by the marking pin 99 so that the hand-held portable rotary saw 20 makes its cut along the line desired by the user.

As shown in FIGS. 1 and 2, the saw extension 10 includes a power control mechanism 90 mounted adjacent the control grip 82 of the upwardly extending arm 80. The power control mechanism 90 includes a power socket 92 electronically connected to a master power cord 94 through a trigger switch 96. The trigger switch 96 is operable positioned within the control grip 82 for enabling control of power from the master power cord 94 to the saw power cord 30. The power socket 92 can be structured to include several connections so that multiple cords can be plugged in simultaneously, some using standard plug adapters and at least one using an industrial adapter. The power socket 92 can also include additional elements, such as surge protection, if desired.

In use, the hand-held portable rotary saw 20 is positioned on the base 40 of the saw extension 10 such that the saw blade 26 is positioned through the slot 42, and the hand-held portable rotary saw 20 is removably fastened to the base 40 with the means for removably fastening described above. In the preferred embodiment, the guide plate 24 is positioned on the planar upper surface 44 of the base 40 such that it abuts the locking sidewall 64. The clamping screw 60 is threadedly engaged through the locking plate 62 and rotated to clamp the guide plate 24 between the clamping screw 60 and the guide plate 24. The guide plate 24 is then further locked onto the base 40 by positioning the two locking pins 50 through the two guide plate apertures 25 and threadedly engaging the body 56 of each of the two locking pins 50 with the two locking apertures 52 of the base 40 such that the head 54 of each of the two locking pins 50 fits snugly against the guide plate 24 and securely holds it in place.

Once the hand-held portable rotary saw 20 is locked in place, the saw power cord 30 is plugged into the power socket 92 of the power control mechanism 90 and the master power cord 94 of the saw extension 10 is plugged into an external power source (not shown). The excess lengths of the saw power cord 30 and the master power cord 94 can be hung on a pair of opposing hooks 88 extending from the side of the upwardly extending arm 80. Once the saw switch 34 is fastened into the powered position with a fastening strap 36, the user can operably control the motor 28 of the hand-held portable rotary saw 20 with the trigger switch 96 of the power control mechanism 90. The saw extension 10 is positioned on the surface 12 to be cut and aligned using the marking pin 99. When ready, the user depresses the trigger switch 96 from the off position to the on position, thereby operably connecting the motor 28 of the hand-held portable rotary saw 20 to the power source and causing the saw blade 26 to rotate and cut the surface 12. By pushing the upwardly extending arm 80, grasping the control grip 82 and the second grip bar 86, the user can propel the saw extension 10 across the surface 12, the plurality of wheels 70 supporting the base 40 above the surface 12 and guiding the saw extension 10 along a straight line. The hand-held portable rotary saw 20, mounted upon the saw extension 10, can be used to cut or etch almost any surface, including hard concrete, wooden roofing, or any other surface.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A saw extension for supporting a hand-held portable rotary saw above a surface, the hand-held portable rotary saw having a housing, a guide plate, a saw blade attached to the housing and rotatable relative thereto about an axis of rotation, and a motor operably connected to the saw blade and electrically connected to a saw power cord, the saw extension comprising:

a base defining a slot, the slot being shaped to allow the saw blade to be positioned therethrough;

a means for removably fastening the hand-held portable rotary saw to the base;

a plurality of wheels positioned to support the base above the surface for rectilinear movement thereupon;

an upwardly extending arm extending from the base to a control grip, the upwardly extending arm being positioned for pushing the base across the surface; and a power control mechanism mounted adjacent the control grip of the upwardly extending arm, the power control mechanism having a power socket electronically connected to a master power cord through a trigger switch, the trigger switch being operable positioned within the control grip for enabling control of power from the master power cord to the saw power cord.

2. The saw extension of claim 1 further comprising a second grip bar extending laterally from the upwardly extending arm.

3. The saw extension of claim 2 wherein the second grip bar includes a resilient grip cover having a wrench aperture shaped to receive a wrench.

4. The saw extension of claim 1 wherein the means for removably fastening includes at least one locking pin and at least one locking aperture in the base, the at least one locking pin removably engaging the at least one locking aperture, the at least one locking pin being shaped to removably engage the guide plate of the hand-held portable rotary saw when the at least one locking pin is removably engaged with the at least one locking aperture of the base.

5. The saw extension of claim 1 wherein the means for removably fastening includes a clamping screw and a locking plate, the locking plate being supported above the base by a locking sidewall, the clamping screw threadedly engaging the locking plate such that the clamping screw moves towards or away from the base when the clamping screw is rotated, whereby the clamping screw locks the guide plate against the base when the guide plate is positioned against the locking sidewall.

6. A method for cutting a surface with a hand-held portable rotary saw, the method comprising the steps of:

a) providing a hand-held portable rotary saw having a housing, a guide plate, a saw blade attached to the housing and rotatable relative thereto about an axis of rotation, and a motor operably connected to the saw blade, electrically connected to a saw power cord, and operably controlled with a saw switch, the saw switch pivoting between an unpowered position and a powered position;

b) providing a saw extension having a base defining a slot; a plurality of wheels positioned to support the base above the surface for rectilinear movement thereupon; an upwardly extending arm extending from the base to a control grip, the upwardly extending arm being positioned for pushing the base across the surface; and a power control mechanism mounted adjacent the control grip of the upwardly extending arm, the power control mechanism having a power socket electronically connected to a master power cord through a trigger switch, the trigger switch being operable positioned within the control grip and movable between an off position and an on position;

c) providing a power source;

d) fastening the hand-held portable rotary saw on the base of the saw extension such that the saw blade is positioned through the slot;

e) fastening the saw switch in the powered position;

f) inserting the saw power cord into the power socket of the saw extension;

g) connecting the master power cord to the power source;

h) positioning the saw extension on the surface;

i) depressing the trigger switch from the off position to the on position, thereby operably connecting the motor of the power saw to the power source and causing the saw blade to rotate and cut the surface; and j) pushing the upwardly extending arm, thereby propelling the saw extension across the surface, the plurality of wheels supporting the base above the surface and guiding the saw extension along a straight line.

* * * * *